United States Patent [19]

Schram et al.

[11] 4,090,660

[45] May 23, 1978

[54] DISPOSABLE DRINKING CUP LID

[76] Inventors: Robert A. Schram, 3077 Shore Rd., Bellmore, N.Y. 11710; Alfred Affrunti, Jr., 311 W. Broadway, Port Jefferson, N.Y. 11777; Angela Affrunti, 1418 Stonybrook Rd., Stonybrook, N.Y. 11790

[21] Appl. No.: 751,104

[22] Filed: Dec. 16, 1976

[51] Int. Cl.[2] ..... B65D 5/64; A47G 19/22

[52] U.S. Cl. ..... 229/43; 220/306; 215/253; 220/270; 220/90.2

[58] Field of Search ..... 229/43, 2.5; 215/253, 215/254; 220/306, 270, 90.2, 90.4, 90.6

[56] References Cited

U.S. PATENT DOCUMENTS

| | | | |
|---|---|---|---|
| 1,242,604 | 10/1917 | Schmitt | 215/254 |
| 2,689,664 | 9/1954 | Vingron | 215/253 |
| 2,738,090 | 3/1956 | Davis | 215/253 |
| 2,984,381 | 5/1961 | Bennett | 220/306 |
| 3,285,491 | 11/1966 | Bessett | 229/25 EC |
| 3,355,060 | 11/1967 | Reynolds et al. | 220/270 |
| 3,387,765 | 6/1968 | Davis | 220/306 X |
| 3,421,681 | 1/1969 | Frank | 215/254 X |
| 3,822,030 | 7/1974 | Tanzer | 220/90.2 |
| 3,977,559 | 8/1976 | Lombardi | 229/43 |
| 3,994,411 | 11/1976 | Elfelt et al. | 229/43 X |

*Primary Examiner*—Davis T. Moorhead
*Attorney, Agent, or Firm*—Richard L. Miller

[57] ABSTRACT

A disposable lid for a conventional paper cup, the lid having a groove on its underside for snap fitting on the cup, and the lid additionally including a pair of radial score lines that can be torn so to form a liftable tab so a person can drink from the cup while the lid is still on; the tab being pivotable so to refit on the cup in order to close the same.

3 Claims, 5 Drawing Figures

Fig. 1
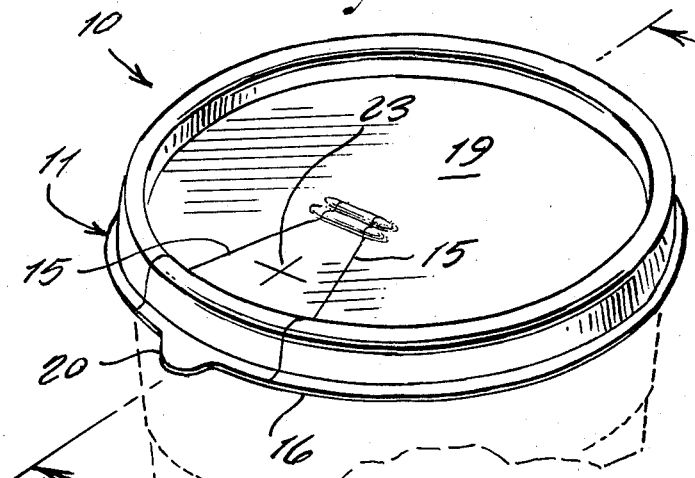
Fig. 2
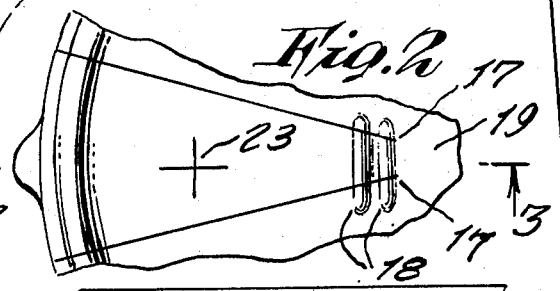
Fig. 5
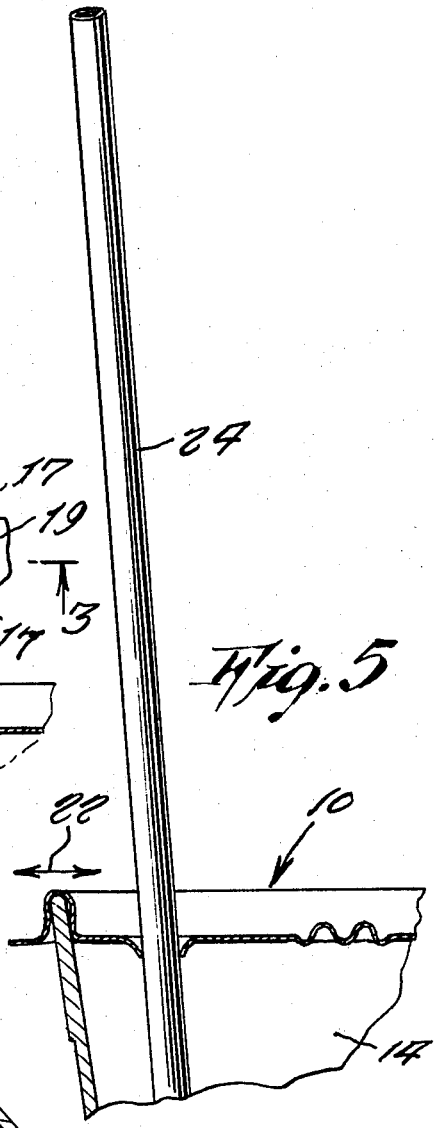
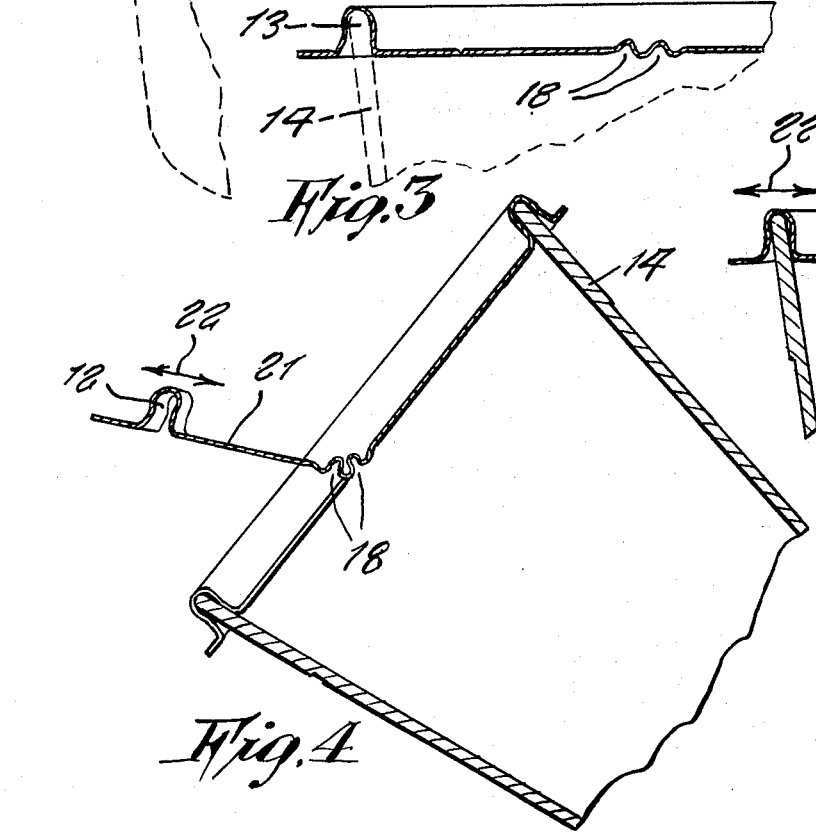
Fig. 3
Fig. 4

DISPOSABLE DRINKING CUP LID

This invention relates generally to disposable drinking cups. More specifically it relates to a disposable lid for closing such a drinking cup.

A principal object of the present invention is to provide a drinking cup lid that is scored so to form a liftable tab in order that beverage can be drunk from the cup without need to remove the entire lid, and after which the tab can be closed down on the cup so to close same, so to maintain a remainder of the beverage within the cup unaffected by exterior temperatures, and thus a hot coffee remains hot or a cold beer or soda remain cool.

Another object is to provide a drinking cup lid which will aid to prevent spilling a content of a cup that is accidentally turned over.

Yet another object is to provide a drinking cup lid having a tab that is radially extendable so to refit a drinking cup edge without snap-fitting thereupon but which is rather guided thereupon so to be easier for repeated opening and closing.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

FIG. 1 is a perspective view of the invention mounted on a disposable drinking cup.

FIG. 2 is a fragmentary top view thereof.

FIG. 3 is a cross-sectional view on line 3—3 of FIG. 2.

FIG. 4 is a cross-sectional view thereof with tab upwardly pivoted.

FIG. 5 is a cross-sectional view thereof with a drinking straw inserted through the tab.

Referring now to the drawing in greater detail, and more particularly to FIGS. 1 through 4 thereof at this time, the reference numeral 10 represents a disposable lid according to the present invention wherein there is a one piece member 11 made preferably of formed thin sheet plastic and which is circular in shape having a peripheral groove 12 on its underside for snap-fitting on an upper edge 13 of a conventional, disposable drinking cup 14 such as is made either of plasticized paper or of plastic.

In the present invention, a pair of radially extending score lines 15 approximately 30 degrees apart extend from a peripheral edge 16 to a point that does not reach the center of the lid. These inwards ends 17 of the score lines are thus apart a short distance.

A pair of parallel, longitudinal corrugations 18 are bent up on the central area 19 of the member 11 and across which both the score line ends 17 extend transversely.

A tongue 20 is formed along peripheral edge 16 and is located midway between the score lines 15.

The lid 10, thus formed, can be readily snap-fitted upon the drinking cup 14 in a conventional manner after the cup is filled with a beverage. Whenever a person wishes to drink only a portion of the beverage, he simply pulls the tongue 20 upwardly so to tear the lid along the score lines 15 up to their ends 17, thus forming a tab 21 that can be, as shown in FIG. 4, upwardly pivoted about the corrugations 18 without readily breaking off the tab, so that afterwards the tab can be pivoted down again so to reclose the cup.

It is to be noted that the tab does not snap fit on the edge 13 of the cup, but due to the corrugations 18 the tab is able to shift radially back and forth, as indicated by double-headed arrow 22 so to ride over the edge 13 and thus seat itself thereupon, it being understood that the cup side wall is conical so that the upper end thereof adjacent the edge 13 is inclined, thus necessitating the radial shifting of the grooved portion of the tab so to seat itself thereupon. Such construction is easier to lift or close the tab than would be possible if it snap-fitted instead, and it would be repeatedly operative more times in use. One of the corrugations may be of larger transverse diameter than the other so to have more flex than the other to insure against wear out.

In the present invention the tab portion additionally includes a cross score line 23 which can be downwardly punched out as shown in FIG. 5, by a drinking straw 24 if so preferred for sipping the beverage through the otherwise closed lid.

While certain novel features of this invention have been shown and described and are pointed out in the annex claims, it will be understood that various omissions, substitutions and changes in the forms and details of the device illustrated and in its operation can be made by those skilled in the art without departing from the spirit of the invention.

What is claimed is:

1. A disposable drinking cup lid for snap fitting on an upper edge of a disposable drinking cup, comprising in combination, a circular shaped member formed from sheet plastic, a peripheral groove on an underside of said member, and a pair of radially extending score lines starting at a peripheral edge of said member and extending to a point that is short of a center of said member so that inners ends of said scores lines are spaced apart, said score lines defining a tab therebetween when torn along said score lines and a pair of expandable corrugations formed in said member in parallel relationship with each other, and extending transversely across the entire width of the tab between the score lines in a substantially circumferential direction, whereby when the tab is torn along the score lines the tab can be radially moved by expanding and contacting of the corrugations to facilitate seating of the tab over the upper edge of the cup to close the cup, and wherein the corrugations continue across the score lines onto the adjacent circular shaped member.

2. The combination as set forth in claim 1 wherein there is a cross score line upon a portion of said member defining said tab.

3. The combination as set forth in claim 1 and wherein one of the corrugations is of larger diameter than the other to have greater flex than the other.

* * * * *